United States Patent [19]

Sorenson

[11] Patent Number: 4,640,998

[45] Date of Patent: Feb. 3, 1987

[54] PUSH BUTTON SWITCH WITH COMPOUND CONTACT LEVER ACTION

[75] Inventor: Richard W. Sorenson, Avon, Conn.

[73] Assignee: Carlingswitch, Inc., West Hartford, Conn.

[21] Appl. No.: 753,177

[22] Filed: Jul. 9, 1985

[51] Int. Cl.[4] ..... H01H 21/42

[52] U.S. Cl. ..... 200/67 A; 200/68.1; 200/240; 200/DIG. 42

[58] Field of Search ..... 200/67 A, 67 DB, 68.1, 200/69, 72 R, 72 A, 240, DIG. 42

[56] References Cited

U.S. PATENT DOCUMENTS 3,165,611 1/1965 Hagberg ..... 200/68.1
4,118,611 10/1978 Harris ..... 200/67 A

FOREIGN PATENT DOCUMENTS 685569 1/1953 United Kingdom ..... 200/67 DB
743057 6/1980 U.S.S.R. ..... 200/240

*Primary Examiner*—Stephen Marcus
*Assistant Examiner*—Renee S. Luebke
*Attorney, Agent, or Firm*—McCormick, Paulding & Huber

[57] ABSTRACT

A reciprocable push button achieves sequential switching (ON/OFF or ON/ON) through a simple coil spring and pivoted contact lever. The push button has depending legs that cooperate with camming means inside the switch case to swing the contact lever from side-to-side as it pivots between its limit positions. This compound contact lever action is achieved with the push button's straight line motion to provide this sequential switching function.

12 Claims, 8 Drawing Figures

PUSH BUTTON SWITCH WITH COMPOUND CONTACT LEVER ACTION

This invention relates generally to push button electric switches of the type having a button adapted to be pushed to achieve alternate switch conditions in sequence in order to energize either two different circuits from the same switch, or to achieve a simple ON/OFF function. One object of the present invention is to provide a push button switch having a minimum number of component parts within the switch housing, and as a result to avoid the high costs of production and assembly characteristic of push button switches generally.

BACKGROUND OF THE INVENTION

The push button switch disclosed herein has a single coil spring for achieving both return motion of the push button, and also serving as the lost motion connection between the push button and the movable contact lever. In some respects the subject disclosure is similar to that in prior U.S. Pat. No. 4,408,106 assigned to the assignee herein. However, in that prior art patent the push button switch included, in addition to such a spring, a staple or strut element for camming the movable contact element in order to achieve the desired motion of the latter against the force of the single spring. In a copending application, entitled "Push Button Switch", filed Aug. 21, 1984, under Ser. No. 642,838 a single return spring is provided between the push button and the movable contact lever, but this spring has an additional depending leg portion for engaging angularly inclined surfaces on the movable contact lever. This depending leg portion serves much the same purpose as the staple or strut provided in the above mentioned prior art patent. The present disclosure obviates the need for a strut or staple element, and also avoids the need for inclined camming surfaces on the movable contact lever that are engaged by a depending portion of the switch push button return spring.

SUMMARY OF THE INVENTION

The push button switch described and claimed herein includes a switch housing having a generally rectangular shape with a top opening for slidably receiving a push button, and with a bottom wall in which are provided at least a center fixed contact and one additional fixed contact connected to the center contact through a movable contact lever. The movble contact lever has a raised land provided well above its pivot point and a spring is provided between this land and the underside of the push button. One end portion, and preferably both end portions of the movable contact lever define abutment surfaces for selective engagement with depending abutment means provided in the push button itself. One or the other of these depending abutment means engages one or the other of the abutment surfaces on the contact lever to move the lever from one of its limit positions toward the other limit position as a result of initial downward push button movement. The lever is pivotally provided on the center fixed contact for pivotal movement on a transverse primary pivot axis arranged at a slight angle with respect to the horizontal floor or bottom wall of the switch housing. The center fixed contact may be in the a shape of a yoke for so receiving the movable contact lever, and notches are provided on opposite sides of the movable lever for supporting the lever for pivotal motion on the center contact. One of these notches is preferably wider than the other to allow limited swinging or shifting movement of the contact lever in addition to such pivotal motion on said primary axis. One end portion of the lever is adapted to engage one of two fixed contacts provided on either side of the center contact in the bottom wall of the housing. Finally, camming mean is provided in the switch housing for engaging one of the lever end portions as the lever end portion moves into one of its two limit positions so as to achieve a shifting of the lever, at least slightly, on a secondary pivot axis provided at right angles to the transverse primary pivot axis. This compound lever action provides clearance for the depending abutment means on the push button during upward return movement thereof.

BRIEF DESCRIPTION OF THE DRAWINGS

FIG. 5 is taken generally on the line 5—5 of FIG. 2.

DETAILED DESCRIPTION

Turning now to the drawings in greater detail, the push button switch of FIGS. 1–7 comprises a generally rectangular switch housing 10, which housing may be molded of one piece plastic construction or may be formed with an open bottom and fitted with a separately molded bottom wall 12 as shown. The switch housing includes integrally connected end and side walls as indicated generally at 10*a*, 10*b* and 10*c* in FIGS. 1 and 2. These four end and side walls are depicted in horizontal section in FIG. 3. The bottom side and end walls of the switch housing cooperate to define an upwardly open switch cavity, and this cavity has a top opening 10*e* which is also generally rectangular and may be slightly smaller in size than the switch cavity itself in order to slidably receive a vertically movable push button 14. The switch housing 10 may include integrally formed resilient wings (not shown) or may include other devices for mounting of the switch housing in a generally rectangular panel opening or the like. When so mounted an outer bezel portion 10*f* of the switch housing will be all that is visible to the observer.

Figure 7:
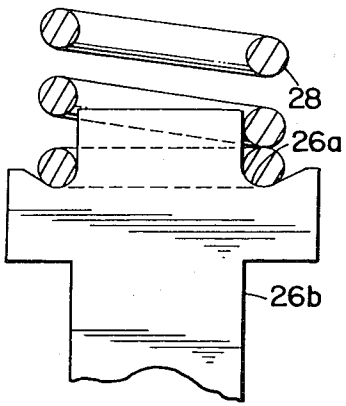
FIG. 7 is a view of the raised land defined by the movable contact lever for receiving the lower end of the return spring.
Figure 1:
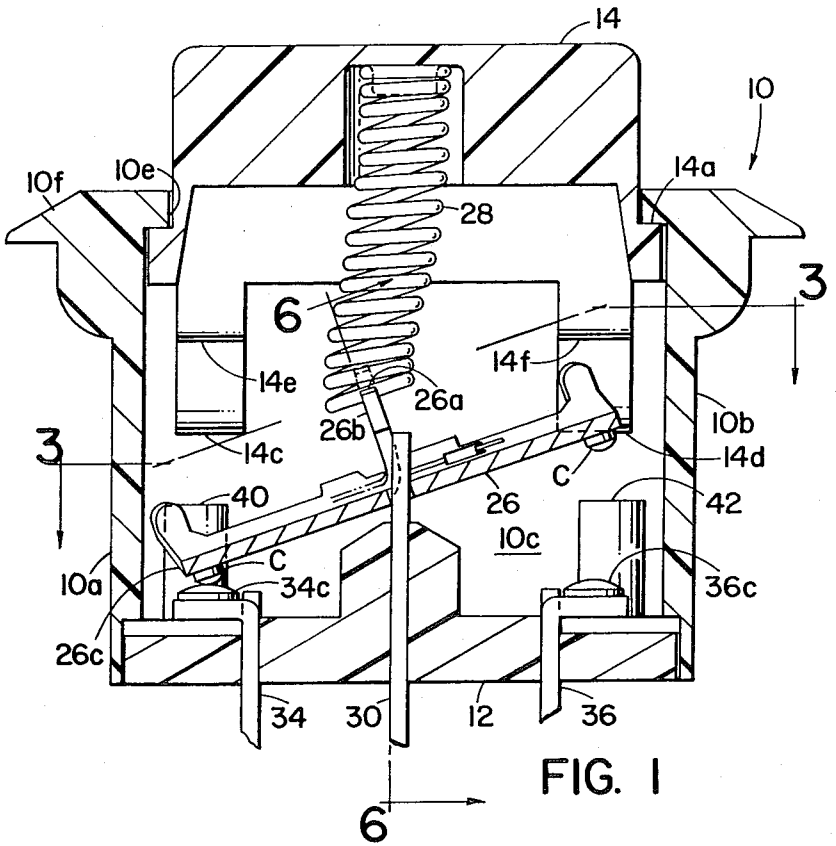
FIG. 1 is a vertical cross sectional view showing one condition for an improved push button switch incorporating the present invention wherein the movable contact lever is in one of its two limit positions.
Figure 2:
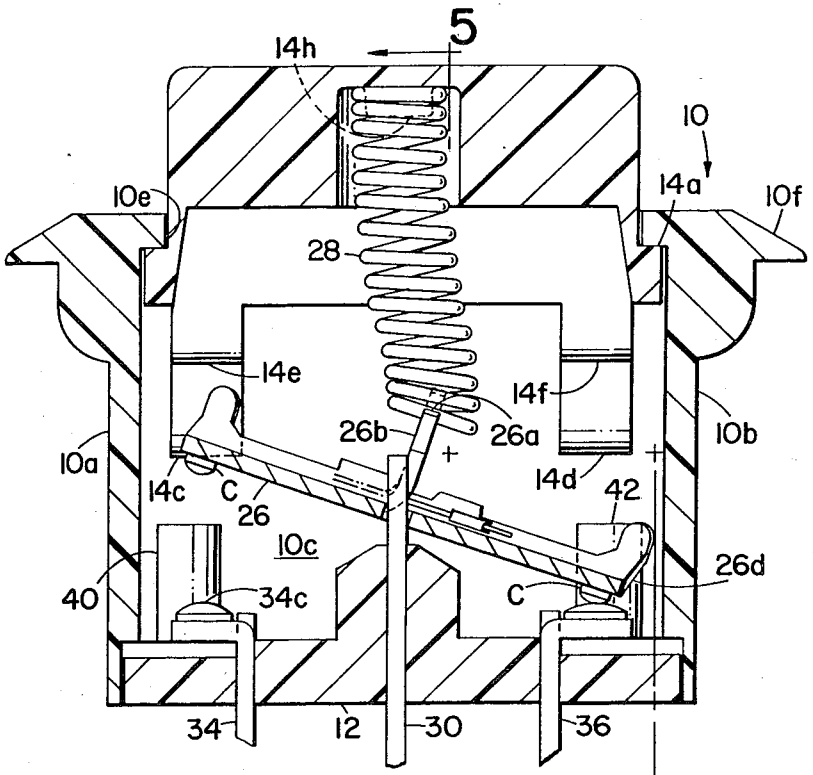
FIG. 2 is a vertical sectional view similar to FIG. 1, but illustrating the movable contact lever pivoted to an alternative or second limit position relative to a primary pivot axis.
Figure 4:
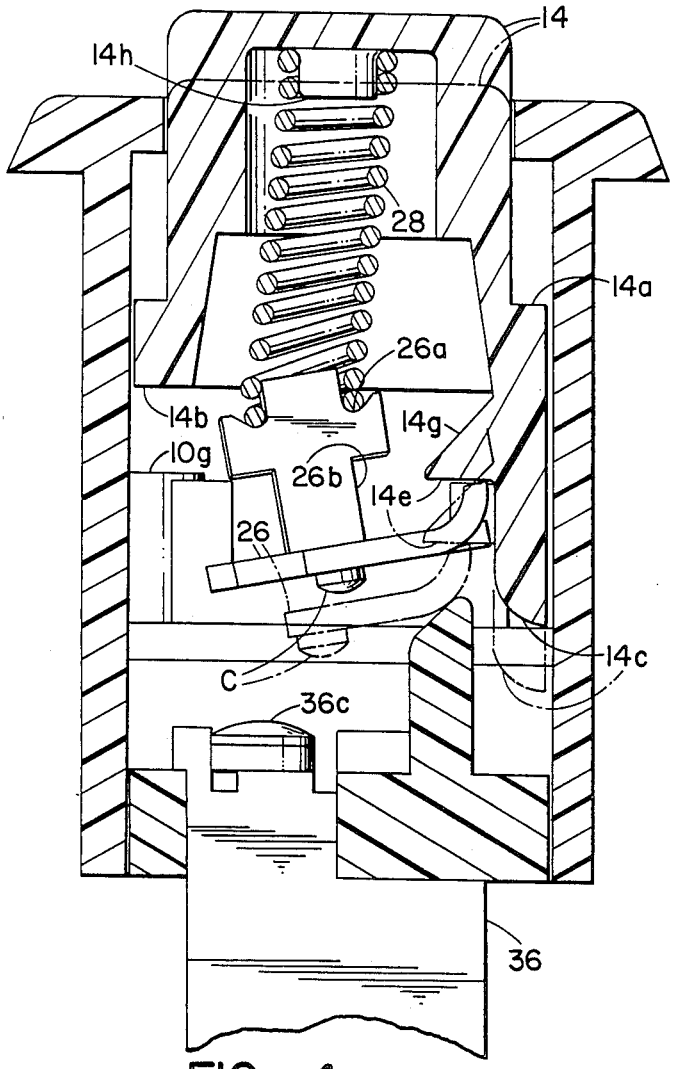
FIG. 4 is a vertical sectional view taken at right angles to the sectional views of FIGS. 1 and 2 and illustrating the push button after it has been depressed slightly relative to the switch housing, this view also illustrating the movable contact lever and push button in phantom lines to illustrate a further depressed position thereof.
Figure 5:
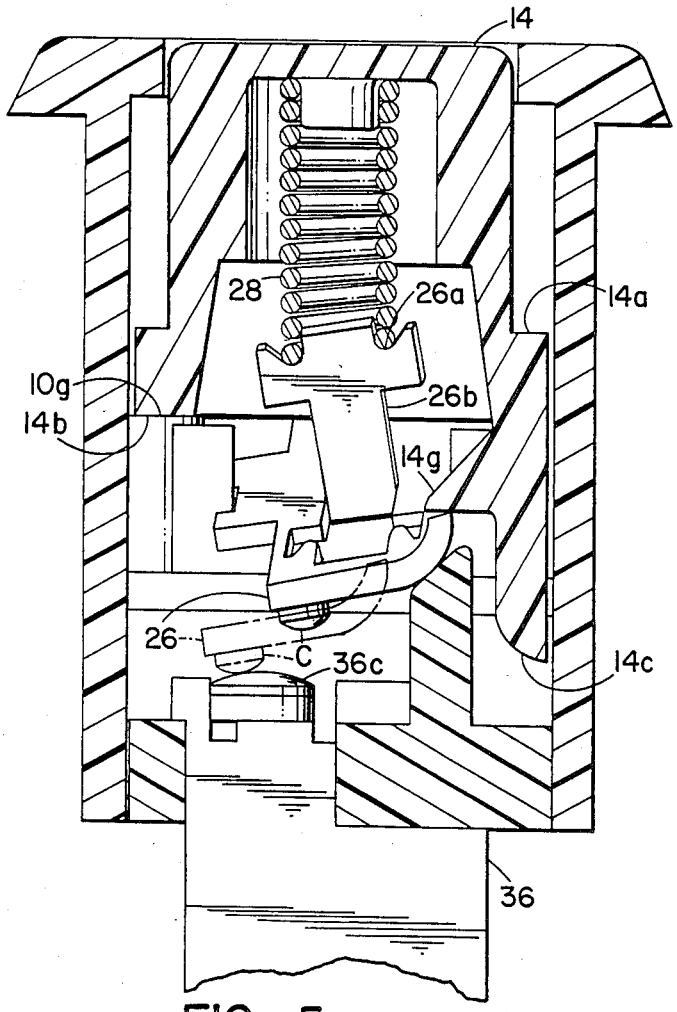
FIG. 5 is a view similar to FIG. 4 but illustrating the push button in a fully depressed condition and illustrating the movable contact lever in successive solid and phantom line positions illustrating relative movement of the lever as it reaches its limit position.

FIG. 4 shows the push button 14 in an intermediate position, that is between the normal extended position illustrated in FIGS. 1 and 2 and a depressed position best shown in FIG. 5. It will be apparent that the push button 14 has a generally rectangular configuration with a peripherally extending inner portion 14*a* that serves to limit the upper position for the push button relative to the switch case 10. The depressed condition may be limited by a stop surface 10*g* best shown in FIGS. 4 and 5 as engaging a portion 14*b* of the push button for this purpose. The push button 14 also includes two depending leg portions 14*c* and 14*d*, which leg portions define abutment means adapted to engage selected surface portions of a contact lever 26 to be described. One abutment means so provided on depending leg 14*c* is illustrated at 14*e* in FIGS. 4 and 5. The other such abutment means provided in spaced relationship to the first mentioned abutment means is illustrated at 14*f* in FIG. 2. Still with reference to the push button 14, and for a purpose to be described hereinafter, each depending leg 14*c* and 14*d* also includes a ramp surface 14*g* which is designed to assure that the movable contact lever 26 will be properly positioned after actuation of the push button 14 and more particularly during return movement of the push button 14 relative to the movable contact lever 26. The push button 14 includes a spring locating nub 14*h* and a coil spring 28 is provided between the push button 24 and a raised land 26*a* defined by upstanding tang 26*b* integrally formed in the movable contact lever 26. This spring 28 serves to bias the push button 14 toward its normal position as illustrated in FIGS. 1 ands 2, and also serves to engage the raised land portion 26*a* of the movable contact lever so as to urge the lever into either one of its two limit positions as illustrated in FIGS. 1 and 2 dpending upon orientation of that lever. FIGS. 1 and 2 show stable positions for the contact lever 26, positions which will be altered only when the tang 26*b* has moved through the vertical plane defined by the center fixed contact 30.

Figure 6:
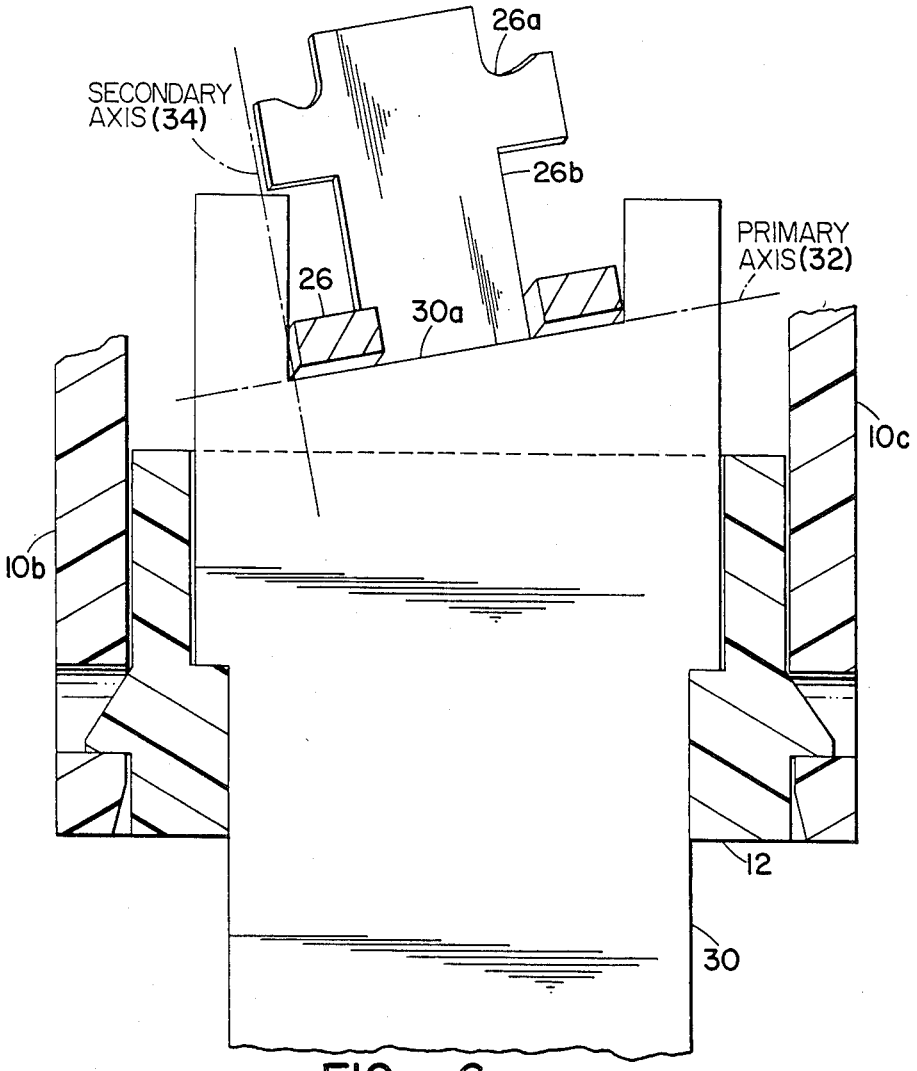
FIG. 6 is a sectional view taken generally on the line 6—6 of FIG. 1 and illustrates the relationship between the primary and secondary axis about which the movable contact lever pivots or swings respectively.

Several fixed contacts are provided in the bottom wall 12 of the switch case housing 10 and these include the center fixed contact 30 having its a upper end portion defining two angularly related pivot axes for the contact lever 26 as shown in FIG. 6. More particularly, the upper end 30*a* of center fixed contact 30 defines a primary pivot axis 32 for the contact lever 26 and this axis is preferably inclined at least slightly with respect to the horizontal or with respect to the bottom wall 12 of the switch housing. A second axis 34 is angularly related to the first or primary axis 32 and is more particularly oriented generally perpendicular thereto so as to define an axis for swinging or shifting movement of the movable contact lever as suggested generally in FIG. 3. This shifting or swinging movement of the movable contact lever 26 about the generally vertical axis 34 permits a compound motion for the contact lever 26 as suggested by the successive positions for this movable contact lever 26 in FIGS. 4 and 5.

Figure 3:
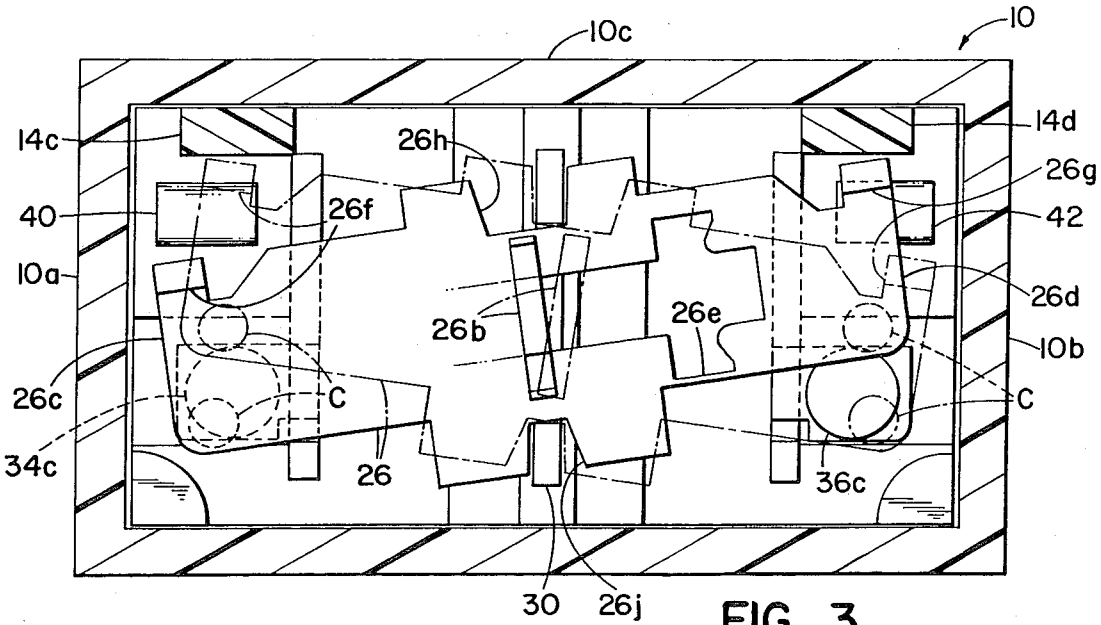
FIG. 3 is a sectional view taken generally on the line 3—3 of FIG. 1 and illustrates the movable contact lever in solid and phantom line positions relative to a secondary axis associated with the center fixed contact, which secondary axis intersects the primary pivot axis for the movable contact lever as illustrated in FIGS. 1 and 2.

Turning next to a more detailed description of the movable contact lever, FIG. 3 shows the lever 26 in plan view with the upstanding tang 26*b* oriented at right angles to the plane of the lever itself. This tang is stamped from the initially flat lever as shown by the opening 26*e*. The end portions of the lever define upturned tabs 26*f* and 26*g* or abutment surfaces that are engaged by the abutment means, 14*e* and 14*f* respectively, on the push button to achieve a desired sequence or cycle of compound lever action to be described.

Still with reference to the lever 26 FIG. 3 also shows the lever with laterally opposed notches 26*h* and 26*j* receiving raised portions of the center fixed contact 30. One such notch 26*h* is larger than the other notch 26*j* so that the lever can swing or shift between the solid and phantom line positions depicted in FIG. 3. The movable contact element C, C can be seen to move horizontally relative to the fixed contacts 34*c* and 36*c* in a manner to be described.

The lever is shown in FIG. 1 in a first and second limit positions wherein one end portion 26*a* has a contact engaging an upper end 34*c* of a fixed contact 34 provided for this purpose in the bottom wall 12 of the housing. FIG. 2 illustrates a contact on the opposite or second end portion 26*d* of the contact lever 26 engaging the upper end of a second fixed contact 36. It will be apparent that the push button switch shown in the drawings is an ON/OFF type. Alternatively an ON/-OFF push button switch can also be provided simply by omitting one of the two fixed contacts 34, 36 and substitute a plastic abutment surface defined for this purpose in the bottom wall 12 of the switch housing. As shown, the opposite end portions 26*c* and 26*d* of the contact lever 26 are provided with precious metal contacts as illustrated at C, C in FIGS. 1 and 2. Further, the fixed contacts 34 and 36 also are provided with precious metal contacts 34*c* and 36*c*. FIGS. 1 and 2 illustrate the opposed limit positions of pivotal movement for the contact lever 26 and it will be apparent that the lower end of coil spring 28 engages the raised land portion 26*a* of the contact lever 26 in thse limit positions at locations spaced to either side of the fixed center contact 30. More particularly, the pivot axis 32 defined by said fixed center contact 30 is fixed in the switch housing, but the lower end of spring 28 moves to one side or the other of this axis to exert a force or moment on lever 26 tending to hold the lever in one or the other of its two limit positions. This is due to the raised land 26*a* being provided well above the flat underside of the contact lever which engages the upper end 30*a* defining pivot axis 32. Thus, the spring 28 serves to hold the movable contact lever 26 in either one of the two positions shown in FIGS. 1 and 2 as a result of this geometry.

In order to achieve the desired switching action of the movable contact lever from the position of FIG. 1 to that of FIG. 2 and vice versa push button 14 is depressed as suggested in FIGS. 4 and 5 from the normal or raised position of FIGS. 1 and 2 through intermediate positions and to a depressed condition such as that shown in FIG. 5. With particular reference to FIG. 4, engagement between depending abutment means 14*e* on the depending leg 14*c* of the push button serves to pivot the contact lever 26 through the series of positions illustrated in FIGS. 4 and 5. Once the push button 14 has been fully as depressed, as suggested in the solid line position of FIG. 5, further movement of the contact lever as necessary to achieve contact between the contact elements C and 36*c* is achieved as a result of spring force from the spring 28. The movable contact lever 26 will ultimately reach the limit position shown in phantom lines in FIG. 5 as a result of the force provided from spring 28 and as a result of the cooperative action of fixed camming means 40 provided for this purpose in the bottom wall 12 of the switch housing. Such camming means preferably comprises an integrally formed post 42 having a canted upper end as shown in FIG. 4. The camming surface 40 will achieve a swinging or shifting movement of the movable contact lever 26 from whatever position it has assumed as a result of downward movement of the push button to a position as shown in solid lines in FIG. 3 (that is pivoted about the secondary axis 34 defined by the fixed center contact and in a counterclockwise direction relative to that axis 34). This shifting or swinging movement of the movable contact lever 26 allows for return movement of the push button 14 and of the depending legs without causing any corresponding pivotal movement of the contact lever 26 on its primary pivot axis. Thus, the contact lever 26 will be in one of its two limit positions and will remain there as the push button 14 returns after it has been released by the user and moves upwardly as a result of the spring 28. The spring 28 not only serves to maintain the movable contact lever 26 in whatever limit position it had assumed, but as pressure is released on the push button itself the spring urges the lever to one or the other of its limit positions whichever limit position it is then closer to.

Upon depressing the push button once again (that is after it had returned to its normal position) the sequence will be repeated, and the downwardly moving abutment means 14*e* on the other leg of the push button will engage an opposite end portion of the lever 26 to cause motion of the lever opposite to that described previously.

Figure 8:
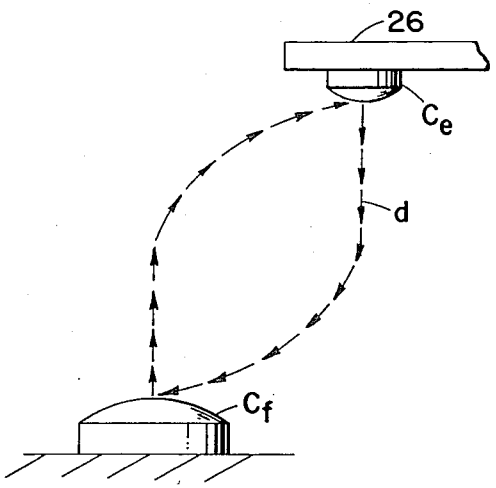
FIG. 8 is a schematic view of one end of the movable contact lever and the fixed contact associated with it. The arrows illustrate contact closing and contact opening movement.

The compound action of the movable contact lever 26 can be described with reference to FIG. 8 as follows. This view shows movable lever contact $C_e$ separated from fixed contact $C_f$ in one of the two limit positions for the switch (refer to FIGS. 1 and 2). Pushing the push button down caused downward movement of the contact $C_e$ in FIG. 8, and also the shifting movement suggested by the line of arrows labeled d in FIG. 8. After the push button is allowed to return to its normal position these contacts $C_e$ and $C_f$ remain closed until the push button is again depressed to open these contacts. The line of arrows labeled U in FIG. 8 suggests the path of movement for the movable contact $C_e$ as it moves back to the position shown in FIG. 8. A hysteresis effect is achieved whereby the lever follows a compound motion about the two angularly related axes 32 and 34 as the switch is successively cycled to provide two different switch conditions in response to the same up and down motion for the push button itself.

I claim: -

1. A push button switch assembly comprising:

a swtich housing having a bottom wall and defining a top opening, a push button slidably received in said top opening for downward movement from and upward return movement to a normal position, fixed contacts in said housing bottom wall and including a center fixed contact and at least one fixed contact spaced from said center fixed contact, a movable contact level in said housing pivotably provided on an upper end of said center fixed contact for pivotal movement on a primary axis between first and second limit positions, said contact lever having one end portion adapted to abut said one fixed contact in said first limit position for said lever, said contact lever having an abutment surface spaced from said primary axis and opposite said one end portion thereof, and said lever also including a raised land located between said one end portion and said abutment surface thereof, depending abutment means provided on said push button for engagement with said contact lever abutment surface during downward movement of said push button to urge said lever from said first limit position toward said second contact lever limit position, biasing means acting between said raised land and said push button to return the latter to its normal position and to urge said contact lever toward said first or said second limit positions as a result of pivotal motion of said raised land beyond a mid-position of the lever between said limit positions thereof, and camming means for shifting said contact lever laterally as said lever moves beyond said mid-position.

2. The push button switch assembly of claim 1 wherein said center fixed contact upper end and said movable contact lever cooperate to define said primary pivot axis for achieveing up and down movement of said one lever end portion relative to said one fixed contact, said cooperating lever and center fixed contact being configured so that limited lateral shifting movement of said contact lever provides for side-to-side movement of said one lever end portion relative to said one fixed contact.

3. The push button switch assembly of claim 2 wherein said push button has a second depending abutment means spaced from said first mentioned abutment means, said movable contact lever having a second abutment surface spaced from said first mentioned abutment surface thereof, said second abutment surface provided adjacent said one end portion of said contact lever, and said lever having an opposite end portion with said first mentioned abutment suface defined adjacent thereto.

4. The push button switch assembly of claim 2 wherein said shifting movement of said contact lever is restricted to swinging movement about a secondary axis oriented generally perpendicular to that of said primary pivot axis.

5. The push button switch assembly of claim 4 wherein said primary axis is oriented generally parallel to said switch housing bottom wall and wherein said secondary axis is oriented generally parallel to said direction of push button movement.

6. The push button switch assembly of claim 4 wherein said contact lever has an end portion opposite said one end portion, said opposite end portion defining a second abutment surface spaced from said first mentioned abutment surface in said contact lever, and a second depending abutment means in said push button spaced from said first mentioned abutment means thereof for enagement with said second abutment surface in said opposite end portion of said contact lever.

7. The push button switch assembly of claim 6 wherein said first mentioned depending abutment means on said push button is disengaged from said first mentioned abutment surface of said contact lever during upward return movement of said push button, and wherein said second depending abutment means on said push button is similarly disengaged from said second contact lever abutment surface during upward return movement.

8. The push button switch assembly of claim 6 wherein second camming means is provided in said switch housing in spaced relation to said first mentioned camming means to cause shifting of said contact lever and consequent disengagement between said second abutment surface and said second depending abutment means to permit movement of said contact lever from said first to said second limit positions in response to said first mentioned downward push button movement succeeding return movement thereof as referred to in claim 5 above.

9. A push button switch assembly comprising a switch housing having a bottom wall and defining a top opening, a push button slidably received in said top opening for downward movement from and upward return movement to a normal position, fixed contacts in said housing bottom wall and including a center fixed contact and at least one fixed contact spaced from said center fixed contact, a movable contact lever in said housing pivotably provided on an upper end of said center fixed contact for movement between first and second limit positions, said lever having one end portion adapted to abut said one fixed contact in said first limit position for said lever, said contact lever having an abutment surface spaced from said one end portion thereof, and said lever also including a raised land located between said one end portion and said abutment surface thereof, depending abutment means provided on said push button downard movement of said push button to urge said lever from said first limit position towards said second limit position, biasing means acting between said raised land and said push button to return the later to its normal position and to urge said contact lever toward said first or second limit position as a result of pivotal motion of said raised land beyond a midposition of the lever between said limit positions thereof, said center fixed contact upper end and said movable contact lever being so configured that limited lateral shifting movement of the lever is provided for, said depending abutment means on said push button being disengaged from said abutment surface of said contact lever during upward return movement of said push button, and camming means provided in said housing for causing said contact lever shifting movement.

10. The push button switch assembly of claim 9 wherein said first mentioned depending abutment means on said push button is disengaged from said first mentioned abutment surface of said contact lever during upward return movement of said push button, and wherein said second depending abutment means on said push button is similarly disengaged from a second contact lever abutment surface during upward return movement.

11. The push button switch assembly of claim 10 wherein second camming means is provided in said switch housing in spaced relation to said first mentioned camming means to cause shifting of said contact lever and consequent disengagement between said second abutment surface and said second depending abutment means.

12. A push button switch assembly comprising a switch housing having a generally rectangular open top configuration and a bottom wall, a push button movable vertically in said top opening, center fixed contact means provided in said bottom wall and defining a primary and a secondary pivot axis adjacent the upper end thereof, at least one fixed contact also provided in said bottom wall and spaced from said center contact means, a movable contact lever pivotably mounted on said center contact means and having a raised land above said primary pivot axis, said lever having one end portion adapted to abut said one fixed contact in a first limit position for said lever, said lever having a second limit position wherein said lever moves around said primary pivot axis to raise said one end portion above said one fixed contact, biasing means acting between said raised land on said movable contact lever and said push button to urge the push button toward a normal position and to urge said contact lever toward said first or said second limit position according to the position of the lever beyond a mid-position intermediate said first limit position and said second limit position relative said primary pivot axis, said push button having depending abutment means provided thereon, said contact lever having another end portion opposite said one end portion and defining abutment surfaces adjacent said respective lever end portions, said push button abutment means engageable with said abutment surfaces of said contact lever to move said lever from one of said limit positions toward the other of said limit positions in response to initial downward push button movement, and camming means defined by said switch housing for engaging one of said lever end portions as that lever end portion moves into one of its limit positions for shifting said lever slightly on said secondary pivot axis to provide clearance for said depending abutment on said push button during upward return movement of said push button.

* * * * *